US007714512B2

(12) United States Patent
Lambrechts et al.

(10) Patent No.: US 7,714,512 B2
(45) Date of Patent: May 11, 2010

(54) HIGH RED COLOR RENDITION METAL HALIDE LAMP

(75) Inventors: Stefaan M. Lambrechts, Beverly, MA (US); Huiling Zhu, Lexington, MA (US); Jakob Maya, Brookline, MA (US); Timothy Lee Kelly, Boston, MA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 1151 days.

(21) Appl. No.: 11/253,979

(22) Filed: Oct. 19, 2005

(65) Prior Publication Data

US 2007/0085482 A1 Apr. 19, 2007

(51) Int. Cl.
*H01J 61/12* (2006.01)

(52) U.S. Cl. ..... 313/638; 313/637; 313/640

(58) Field of Classification Search ..... 313/637, 313/638, 639, 640, 641, 643, 571
See application file for complete search history.

(56) References Cited

U.S. PATENT DOCUMENTS

| | | | | |
|---|---|---|---|---|
| 4,027,190 | A | 5/1977 | Shintani et al. | |
| 4,360,758 | A | 11/1982 | Thornton, Jr. et al. | |
| 4,643,690 | A | 2/1987 | Caruso et al. | |
| 4,742,268 | A | 5/1988 | Caruso et al. | |
| 4,801,846 | A | 1/1989 | Kramer et al. | |
| 5,256,940 | A | 10/1993 | Wada et al. | |
| 5,461,281 | A | 10/1995 | Fromm et al. | |
| 6,005,346 | A | 12/1999 | Shaffner | |
| 6,031,332 | A | 2/2000 | Wijenberg et al. | |
| 6,300,729 | B1 * | 10/2001 | Keijser et al. | 315/326 |
| 6,469,444 | B1 * | 10/2002 | Leng et al. | 313/637 |
| 6,469,446 | B1 * | 10/2002 | Stockwald | 313/638 |
| 6,605,888 | B1 | 8/2003 | Waymouth et al. | |
| 2003/0141818 | A1 | 7/2003 | Kelly | |
| 2004/0189212 | A1 * | 9/2004 | Ashida et al. | 315/97 |
| 2006/0164017 | A1 * | 7/2006 | Rintamaki et al. | 313/640 |
| 2006/0170363 | A1 * | 8/2006 | Utsubo et al. | 313/640 |

FOREIGN PATENT DOCUMENTS

| | | | |
|---|---|---|---|
| EP | 0 271 911 | | 6/1988 |
| JP | 2004-282216 | * | 7/2004 |
| JP | P2004-281216 | | 7/2004 |
| WO | WO 98/45872 | | 10/1998 |
| WO | WO 02/091428 | A2 | 11/2002 |
| WO | WO 2005/088675 | A1 | 9/2005 |

* cited by examiner

*Primary Examiner*—Ashok Patel
(74) *Attorney, Agent, or Firm*—Kinney & Lange, P.A.

(57) ABSTRACT

An arc discharge metal halide lamp for use in selected lighting fixtures having a discharge chamber with light permeable walls of a selected shape bounding a discharge region of a selected volume through which walls a pair of electrodes are supported with ionizable materials being provided in the discharge region of the discharge chamber comprising at least one member selected from a group consisting of halides of cerium, dysprosium, holmium, lithium, sodium, praseodymium, thallium and thulium, and further comprising a halide of calcium in a selected fraction of that weight total of all halides present in the discharge chamber with this selection depending also on the addition or not of a halide of aluminum. Others of the foregoing halides that are present are provided in amounts with certain limits.

7 Claims, 2 Drawing Sheets

HIGH RED COLOR RENDITION METAL HALIDE LAMP

BACKGROUND OF THE INVENTION

This invention relates to high intensity arc discharge lamps and more particularly to high intensity arc discharge metal halide lamps having improved color rendition while retaining high efficacy.

Due to the ever-increasing need for energy conserving lighting systems that are used for interior and exterior lighting, lamps with increasing lamp efficacy are being developed for general lighting applications. Thus, for instance, arc discharge metal halide lamps are being more and more widely used for interior and exterior lighting because of their high efficacy, generally good color rendering and high luminosity. Such lamps are well known in being offered commercially in a wide range of lumen output and color temperature, and include therein a light-transmissive arc discharge chamber sealed about an enclosed a pair of spaced apart electrodes which typically further contains suitable active materials such as an inert starting gas and one or more ionizable metals or metal halides in specified molar ratios, or both. They can be relatively low power lamps operated in standard alternating current light sockets at the usual 120 Volts rms potential with a ballast circuit, either magnetic or electronic, to provide a starting voltage and current limiting during subsequent operation.

These lamps typically have a ceramic material arc discharge chamber that typically contains, as active materials, quantities of sodium iodide, thallium iodide and one or more rare earth halides such as dysprosium iodide, holmium iodide and thulium iodide, and also contains mercury to provide an adequate voltage drop, or loading, between the electrodes plus an inert starting gas. Commercially available lamps containing these materials have good performance with respect to Correlated Color Temperature (CCT) and much of the Color Rendering Index (CRI), and have a relatively high efficacy that can be up to 95 lumens-per-watt (LPW). However, such lamps usually do not emit light in the red visible light wavelength range sufficiently to satisfactorily render light for use in illuminating many kinds of scenes as compared to the light provided by incandescent sources for this purpose which closely resembles blackbody radiation at equivalent correlated color temperatures.

The color rendering properties of lamps are indicated by a general index termed Ra which can have associated therewith fourteen further indices representing the color rendering properties of selected test colors provided in CIE Publication 13.2 (1974). One such index designated R9 is the red color rendering index for strong red with Munsell notation 4.5 R 4/13, and a blackbody source has a value of 100 on this R9 index. Even though typical commercially available lamps have a good general color index Ra value, the R9 index value for those lamps will be far less than the 100 value of a blackbody source.

Provision of an adequate red component in the illumination used for lighting indoor scenes is very desirable for use in retail outlets to allow them to properly show their wares and the results of their services not least, in some of the latter instances, because human skin has a better appearance under such illumination. Thus, such outlets that can benefit from such an improved source emission spectrum include restaurants, cosmetic shops, jewelry shops and where fresh food products are offered such as meats, fish, fruits and vegetables. Thus, there is a desire for arc discharge metal halide lamps having better color performance while retaining the hue of the light and the high efficacies typically provided by commercially available arc discharge lamps.

BRIEF SUMMARY OF THE INVENTION

The present invention provides an arc discharge metal halide lamp for use in selected lighting fixtures having a discharge chamber with light permeable walls of a selected shape bounding a discharge region of a selected volume through which walls a pair of electrodes are supported in the discharge region separated from one another. Ionizable materials are provided in the discharge region of the discharge chamber comprising at least one member selected from a group consisting of halides of cerium, dysprosium, holmium, lithium, sodium, praseodymium, thallium and thulium, and further comprising a halide of calcium in a selected fraction of that weight total of all halides present in the discharge chamber with this selection depending also on the addition or not of a halide of aluminum. Others of the foregoing halides that are present are provided in amounts with certain limits.

The discharge chamber can have walls formed of polycrystalline alumina, and can be enclosed in a transparent bulbous envelope positioned in a base with electrical interconnections extending from the discharge chamber to the base.

DETAILED DESCRIPTION

Figure 1:
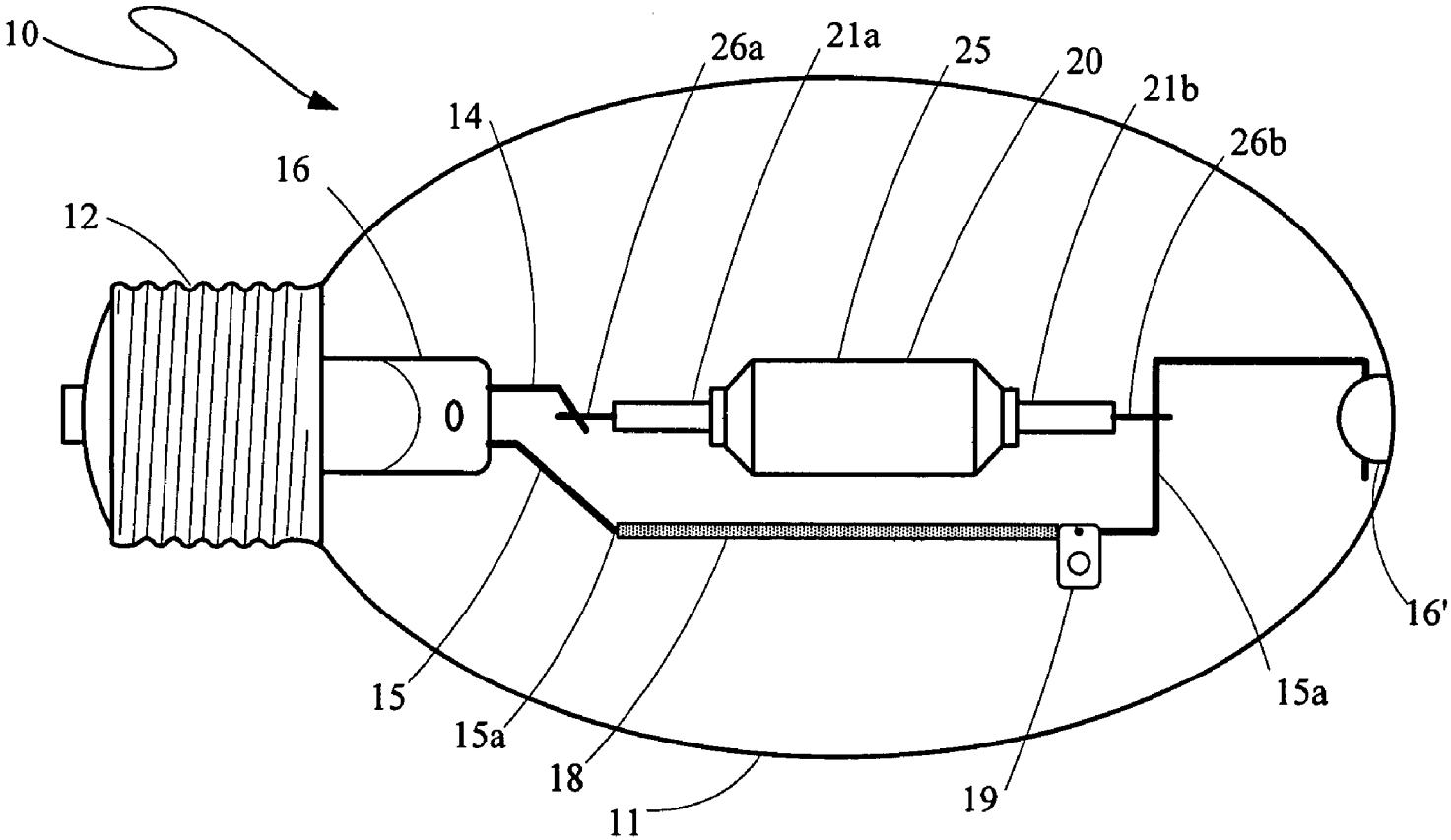
FIG. 1 is a side view, partially in cross section, of an arc discharge metal halide lamp of the present invention having a configuration of a ceramic arc discharge chamber therein.

Referring to FIG. 1, an arc discharge metal halide lamp, 10, is shown in a partial cross section view having a bulbous borosilicate glass envelope, 11, partially cut away in this view, fitted into a conventional Edison-type metal base, 12. Lead-in electrode wires, 14 and 15, of nickel or soft steel each extend from a corresponding one of the two electrically isolated electrode metal portions in base 12 parallely through and past a borosilicate glass flare, 16, positioned at the location of base 12 and extending into the interior of envelope 11 along the axis of the major length extent of that envelope. Electrical access wires 14 and 15 extend initially on either side of, and in a direction parallel to, the envelope length axis past flare 16 to have portions thereof located further into the interior of envelope 11. Some remaining portion of each of access wires 14 and 15 in the interior of envelope 11 are bent at acute angles away from this initial direction after which bent access wire 14 ends following some further extending thereof to result in it more or less crossing the envelope length axis.

Access wire 15, however, with the first bend therein past flare 16 directing it away from the envelope length axis, is bent again to have the next portion thereof extend substantially parallel that axis, and further bent again at a right angle to have the succeeding portion thereof extend substantially perpendicular to, and more or less cross that axis near the other end of envelope 11 opposite that end thereof fitted into base 12. The portion of wire 15 parallel to the envelope length axis passes through an aluminum oxide ceramic tube, 18, to prevent the production of photoelectrons from the surface thereof during operation of the lamp, and also supports a conventional getter, 19, to capture gaseous impurities. A further two right angle bends in wire 15 places a short remaining end portion of that wire below and parallel to the portion thereof originally described as crossing the envelope length axis which short end portion is finally anchored at this far end of envelope 11 from base 12 in a borosilicate glass dimple, 16'.

Figure 2:
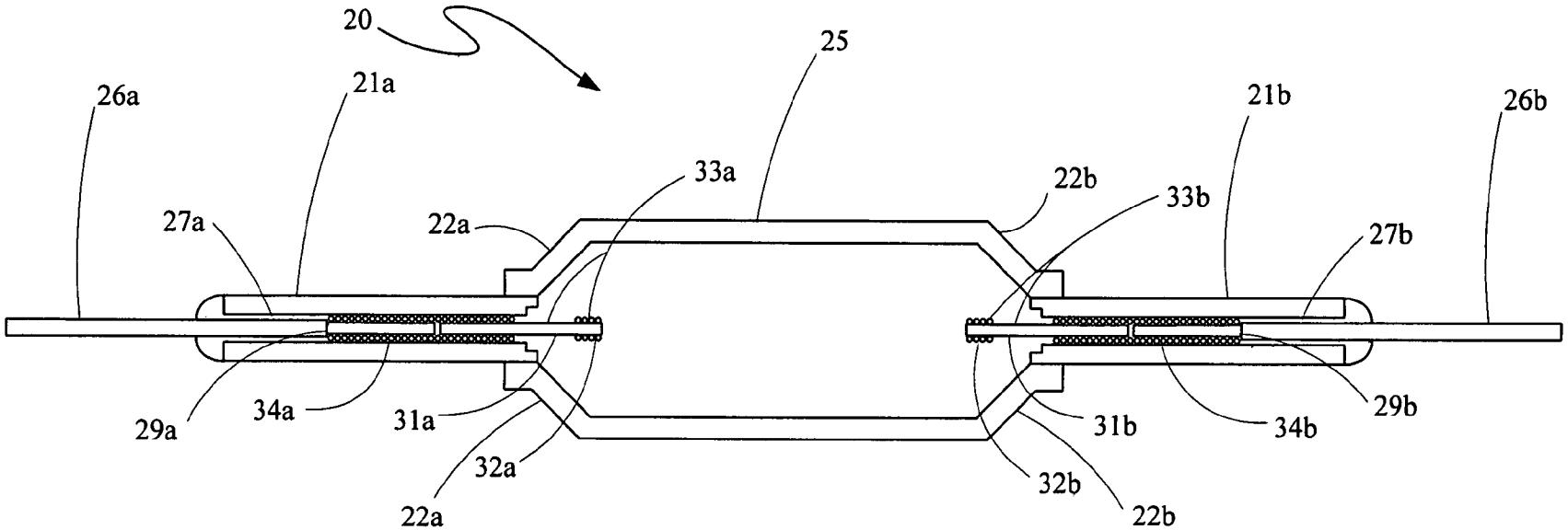
FIG. 2 shows the arc discharge chamber of FIG. 1 in cross section in an expanded view.

A ceramic arc discharge chamber, 20, configured about a contained region as a shell structure having ceramic walls that are translucent to visible light, is shown in one possible configuration in FIG. 1 and in more detail in FIG. 2. Such walls can be polycrystalline walls primarily comprising alumina, or primarily comprising densely sintered aluminum oxide ($Al_2O_3$), or primarily comprising sapphire as examples. The region enclosed in arc discharge chamber 20 contains various ionizable materials, including metal halides of calcium (Ca) and also of at least one of aluminum (Al), dysprosium (Dy), cerium (Ce), gallium (Ga), holmium (Ho), lithium (Li), sodium (Na), thallium (Tl), and thulium (Tm), and also contains mercury (Hg), which together emit light during lamp operation, and further contains a starting gas such as the noble gases argon (Ar) or xenon (Xe) as described in greater detail below. Discharge chamber 20 is provided within envelope 11 either in a nitrogen gas atmosphere under pressure or in a vacuum.

Chamber 20 has a pair of relatively small inner and outer diameter ceramic truncated cylindrical shell portions, or tubes, 21*a* and 21*b*, that are shrink fitted into a corresponding one of a pair of tapered structures, 22*a* and 22*b*, about a centered hole therein at a corresponding one of the two open ends of a primary central portion chamber structure, 25, positioned therebetween. Primary chamber structure 25 is formed as a truncated cylindrical shell of a relatively larger diameter positioned midway between the chamber ends, and chamber 20 has two very short extent smaller diameter truncated cylindrical shell portions with one of them at each end thereof. A partial conical shell portion near each chamber end forms a tapered structure there joining the smaller diameter truncated cylindrical shell portion at each end to larger diameter truncated cylindrical shell portion 25. The wall thickness of the arc discharge chamber is chosen to be about 0.8 mm. These various portions of arc discharge tube 20 are formed by compacting alumina powder into the desired shape followed by sintering the resulting compact to thereby provide the preformed portions, and the various preformed portions are joined together by sintering to result in a preformed single body of the desired dimensions having walls impervious to the flow of gases but transmissive to visible light. Chamber electrode interconnection wires, 26*a* and 26*b*, of niobium each are axially attached by welding to a corresponding lead-through wire extending out of a corresponding one of tubes 21*a* and 21*b*. Wires 26*a* and 26*b* thereby reach and are attached by welding to, respectively, access wire 14 in the first instance at its end portion crossing the envelope length axis, and to access wire 15 in the second instance at its end portion first past the far end of chamber 20 that was originally described as crossing the envelope length axis. This arrangement results in chamber 20 being positioned and supported between these portions of access wires 14 and 15 so that its long dimension axis approximately coincides with the envelope length axis, and further allows electrical power to be provided through access wires 14 and 15 to chamber 20.

FIG. 2 is an expanded cross section view of arc discharge chamber 20 of FIG. 1 showing the discharge region therein contained within its bounding walls that are provided by primary central portion chamber shell structure 25, shell structure end portions 22*a* and 22*b*, and tubes 21*a* and 21*b* extending from ends 22*a* and 22*b*. A glass frit, 27*a*, affixes wire a molybdenum lead-through wire, 29*a*, to the inner surface of tube 21*a* (and hermetically sealing that interconnection wire opening with wire 29*a* passing therethrough). Thus, wire 29*a*, which can withstand the resulting chemical attack resulting from the forming of a plasma in the main volume of chamber 20 during operation and has a thermal expansion characteristic that relatively closely matches that of tube 21*a* and that of glass frit 27*a*, is connected to one end of interconnection wire 26*a* by welding as indicated above. The other end of lead-through wire 29*a* is connected to one end of a tungsten main electrode shaft, 31*a*, by welding.

In addition, a tungsten electrode coil, 32*a*, is integrated and mounted to the tip portion of the other end of the first main electrode shaft 31*a* by welding, so that electrode 33*a* is configured by main electrode shaft 31*a* and electrode coil 32*a*. Electrode 33*a* is formed of tungsten for good thermionic emission of electrons while withstanding relatively well the chemical attack of the metal halide plasma. Lead-through wire 29*a*, spaced from tube 21*a* by a molybdenum coil, 34*a*, serves to dispose electrode 33*a* at a predetermined position in the region contained in the main volume of arc discharge chamber 20. A typical diameter of interconnection wire 26*a* is 0.9 mm, and a typical diameter of electrode shaft 31*a* is 0.5 mm.

Similarly, in FIG. 2, a glass frit, 27*b*, affixes wire a molybdenum lead-through wire, 29*b*, to the inner surface of tube 21*b* (and hermetically sealing that interconnection wire opening with wire 29*b* passing therethrough). Thus, wire 29*b*, which can withstand the resulting chemical attack resulting from the forming of a plasma in the main volume of chamber 20 during operation and has a thermal expansion characteristic that relatively closely matches that of tube 21*b* and that of glass frit 27*b*, is connected to one end of interconnection wire 26*b* by welding as indicated above. The other end of lead-through wire 29*b* is connected to one end of a tungsten main electrode shaft, 31*b*, by welding. A tungsten electrode coil, 32*b*, is integrated and mounted to the tip portion of the other end of the first main electrode shaft 31*b* by welding, so that electrode 33*b* is configured by main electrode shaft 31*b* and electrode coil 32*b*. Lead-through wire 29*b*, spaced from tube 21*b* by a molybdenum coil, 34*b*, serves to dispose electrode 33*b* at a predetermined position in the region contained in the main volume of arc discharge chamber 20. A typical diameter of interconnection wire 26*b* is also 0.9 mm, and a typical diameter of electrode shaft 31 is again 0.5 mm. The distance between electrodes 33*a* and 33*b* is chosen appropriately, and any plane including the longitudinal axis of symmetry of the interior surface of structure 25 passes through the longitudinal centers of these electrodes.

Arc discharge chamber 20 contains as constituents, for a lamp designed to operate at 150 W, 9 to 14 mg of mercury (Hg), argon (Ar) at 100 to 300 torr, and various metal halides specifically including calcium iodide ($CaI_2$) for enhancing red light emission in the wavelength range of 610 nm to 650 nm which is optimal to improve the rendering of red in the emitted discharge light as measured by the R9 color rendering index. That is, calcium radiation in the 610 nm to 650 nm wavelength regions of the spectrum is the primary method of boosting red light emission in the lamp. There are several atomic calcium radiation lines tightly grouped in the 616 nm to 617 nm wavelength range and also in the 644 nm to 650 nm range. However, an even larger contribution to the red light radiation comes from calcium monoiodide molecular radiation in the 623 nm to 650 nm ranges.

Due to the low vapor pressure exhibited by $CaI_2$, arc discharge chamber 20 is constructed so as to be relatively smaller than the chambers provided in typical commercially available lamps to thereby provide higher wall loading through dissipating the light power over a smaller chamber interior surface. This loading, defined as the quotient obtained by dividing the dissipated power of the lamp during operation by the surface area of the entire interior surface of arc discharge chamber 20, is then on the order of 30 W/cm$^2$ or more. This results in raising the temperature of the coldest spot in the chamber which result significantly increases the amount of calcium in the discharge gas or vapor phase to thereby increase emitted red light radiation.

Further increases in the amount of calcium in the discharge gas or vapor phase to further increase the emitted red light radiation can be obtained by adding a complexing agent for $CaI_2$ to the chamber constituents of either aluminum iodide ($AlI_3$) or gallium iodide ($GaI_3$) which agent serves to further enhance the vapor pressure of $CaI_2$. However, use of a complexing agent such as $AlI_3$, for instance, also has the unwanted effects of reducing the luminous flux of the emitted light over time from the initial value thereof while at the same time increasing the Correlated Color Temperature (CCT) and decreasing the R9 red color rendering index. Thus, relatively little of $AlI_3$ must be for this purpose if any at all is chosen to be used.

Although sodium iodide (NaI) must be used in sufficient quantity to provide sufficient radiated light, reducing the value thereof used from what is typical in current commercially available lamps provides a further improvement of the R9 red color rendering index but at the cost of a reduced CCT value. The CCT value can be recovered by the addition of a small amount of lithium iodide (LiI).

Typically, thallium iodide (TlI) is included in the chamber metal halide constituents to provide emitted green light radiation for balanced color and high efficacy, and to suppress emitted blue light radiation while enhancing calcium atomic and molecular emitted red light radiation. Increasing the quantity of TlI in the constituents in chamber 20 affects the R9 red color rendering index by suppressing calcium radiation in the emitted blue light wavelength 380 nm to 450 nm range and favoring calcium emission in the 615 nm to 650 nm range. Significant self-absorption of Tl atomic radiation at the 377.7 nm wavelength is believed to cause it to become self-reversed, i.e. there being a sufficient number of atoms thereof per unit volume to absorb their own emitted radiation and together make this constituent effectively a radiation absorber, and so provide a broad absorption notch that is increasingly widened into the visible blue wavelength with increasing quantities of TlI. This effect provides a very useful mechanism to limit radiation in the blue wavelength region to thereby increase the R9 red color rendering index, lower the value of the CCT, and balance the spectral output to provide a white light source. Other halides that can also be chosen to be included in the constituents of chamber 20 for various purposes include halides of the elements dysprosium (Dy), cerium (Ce), holmium (Ho), and thulium (Tm) as indicated above, and the halides can be chosen to be bromides as alternatives to the iodides described.

Table 1 presents performance data for some embodiments of the invention for 4000K CCT value lamps as well as data from a typical commercially available lamp for comparison.

TABLE 1

| LAMP Nr | NaI [mg] | LiI [mg] | $CaI_2$ [mg] | $AlI_3$ [mg] | TlI [mg] | $DyI_3$ [mg] | LPW | CCT [K] | Duv | CRI | R9 |
|---|---|---|---|---|---|---|---|---|---|---|---|
| Comm. 4300K | | | | | | | | 4239 | +2.2 | 91 | +40.0 |
| 0915-5 | 0.18 | 0.0 | 5.0 | 0.0 | 0.5 | 1.02 | 86.2 | 4344 | −1.7 | 80 | +149.2 |
| 0813-5 | 0.15 | 0.0 | 4.0 | 0.0 | 0.5 | 0.85 | 82.9 | 4363 | +3.6 | 80 | +144.0 |
| 0730-6 | 0.09 | 0.0 | 4.0 | 0.0 | 0.9 | 0.51 | 81.7 | 4176 | +9.0 | 75 | +159.2 |
| 093004-1 | 0.21 | 0.0 | 6.0 | 0.0 | 0.6 | 1.19 | 85.3 | 4004 | +2.4 | 77 | +162.4 |
| 093004-2 | 0.21 | 0.0 | 6.0 | 0.0 | 0.6 | 1.19 | 87.1 | 4116 | −2.2 | 84 | +137.4 |
| 093004-3 | 0.21 | 0.0 | 6.0 | 0.0 | 0.6 | 1.19 | 86.4 | 4074 | −5.1 | 86 | +135.2 |
| 093004-4 | 0.21 | 0.0 | 6.0 | 0.0 | 0.6 | 1.19 | 86.6 | 4143 | −4.1 | 84 | +140.1 |
| 093004-5 | 0.21 | 0.0 | 6.0 | 0.0 | 0.6 | 1.19 | 84.9 | 4093 | −3.5 | 83 | +142.8 |
| 093004-6 | 0.21 | 0.0 | 6.0 | 0.0 | 0.6 | 1.19 | 86.7 | 4095 | −1.1 | 82 | +147.2 |

In Table 2, Lamp A is a typical commercially available 3000K CCT value metal halide lamp having a suitable mix of arc discharge chamber constituents including sodium iodide, thallium iodide, lithium iodide and the rare earth iodides of dysprosium, holmium and thulium. The red color rendering index R9 value is quite low and measures about −18.

TABLE 2

| Lamp A | Lpw | CCT | Duv | CRI | R9 |
|---|---|---|---|---|---|
| Comm. 3000K | 86 | 2937K | −4.1 | 84 | −18 |

Table 3 comprises the data obtained from prototype lamps. All the lamps were tested on a 150 W electronic ballast in a vertical position. Lamp-81-03 therein includes in the mix of arc discharge chamber constituents the following five components NaI, TlI, $CaI_2$, LiI and $AlI_3$. The ratio of NaI to LiI is chosen for this lamp to obtain the desired color temperature value (3000K CCT) and a high value for the red color rendering index R9 of +119.

In Table 3, the molar quantities of $CaI_2$ present in the chamber constituents is between 55 and 75% of the total molar quantities of the halides present. Obtaining emissions from the lamps of white light around Duv≦5 leads to the lamps in Tables 1 and 3 being provided with NaI and $CaI_2$ in quantities such that the molar ratios thereof ($CaI_2$/NaI) exceed 1.0. Tl salt is also added to increase the efficacies of the lamps such that the molar ratio $CaI_2$/TlI thereof in the chambers is greater than 6.0. However, TlI also tends to give a greenish hue and forces the Duv of the lamps to larger values (or moves the color values away from the black-body characteristic) to result in poorer quality white light. Therefore, the molar quantity of TlI is limited in chambers 20 of these lamps to being typically less than about 18% of the total molar quantities of the halides present therein.

The lamps in Table 1 have no $AlI_3$ in the halides provided in the arc discharge chambers 20 thereof thereby yielding superior red color rendering index R9 values from 135 up to 159 for CCT>4000K. Lamps in Table 3, on the other hand, have lower color temperatures in a range from 2850 to 3550K and contain some $AlI_3$ among the chamber constituents to ensure relatively high red color rendering index R9 values from 60 to 144. These additions of $AlI_3$ to the chambers constituents mix, in molar quantities that are less than 5% of the total molar quantities of all the halides present in those chambers, thus provide good results.

TABLE 3

| L A M P Nr | NaI [mg] | LiI [mg] | $CaI_2$ [mg] | $AlI_3$ [mg] | TlI [mg] | $DyI_3$ [mg] | LPW | CCT [K] | Duv | CRI | R9 |
|---|---|---|---|---|---|---|---|---|---|---|---|
| -70-01 | 1.0 | 0.0 | 3.0 | 0.25 | 0.4 | 0.0 | 92.5 | 3136 | −0.4 | 83 | +60.8 |
| -66-02 | 1.0 | 0.0 | 4.0 | 0.25 | 0.7 | 0.0 | 91.9 | 3040 | +2.1 | 86 | +80.0 |
| -81-02 | 1.0 | 0.0 | 5.0 | 0.25 | 0.7 | 0.0 | 85.9 | 2885 | −4.3 | 87 | +77.1 |
| -81-00 | 1.0 | 0.0 | 6.0 | 0.25 | 0.7 | 0.0 | 84.6 | 3084 | −5.5 | 81 | +110.5 |
| -81-01 | 1.0 | 0.0 | 7.0 | 0.25 | 0.7 | 0.0 | 85.2 | 3111 | −4.1 | 82 | +111.8 |
| -81-03 | 0.5 | 0.1 | 3.0 | 0.25 | 0.4 | 0.0 | 78.7 | 3123 | −6.4 | 80 | +119.0 |
| -91-00 | 0.5 | 0.1 | 4.0 | 0.25 | 0.4 | 0.0 | 79.3 | 3323 | −6.7 | 75 | +144.0 |
| -91-01 | 0.5 | 0.1 | 5.0 | 0.25 | 0.4 | 0.0 | 78.0 | 3347 | −6.6 | 77 | +138.0 |
| -70-00 | 0.5 | 0.0 | 3.0 | 0.25 | 0.4 | 0.0 | 75.3 | 3556 | −1.2 | 75 | +137.1 |

The arc discharge chamber constituents in Lamp-70-01 comprises NaI, $CaI_2$, TlI and $AlI_3$ and there is no LiI present in the chamber. This results in a lamp with a CCT value near 3000K and with a value for red color rendering index R9 of +60.8. In Lamp-81-03, the amount of NaI has been reduced from 1 mg to 0.5 mg resulting in a lamp with a very high value for red color rendering index R9. The R9 index value increased from +60.8 to +119 and this was accomplished using the same amount of $CaI_2$, TlI and $AlI_3$. The lamps-70-01 and -81-03 have almost the same CCT values of 3136K and 3123K, respectively.

Maintaining the color temperature of about 3000 K in this second lamp was accomplished by adding a small amount of LiI to the arc chamber constituents. Balancing the amounts of NaI and LiI in arc discharge chamber 20 allows fabricating lamps with extremely high R9 index values that can be made at a specific value for the CCT. The data presented for Lamp-70-00 shows that reducing the amount of NaI alone results in an undesirable increase in its CCT value. Avoiding such a color temperature shift while maintaining a very high R9 index value can be accomplished by adding a small amount of LiI (0.1 mg) to the chamber constituents mix.

However, increasing the amount of added LiI too much has the effect of both reducing the lamp CCT value and its efficacy without contributing significantly more to the value for red color rendering index R9 since emissions at its emitting wavelengths are not as effective for this purpose as are the emissions from $CaI_2$. Therefore, limiting the amount provided in the arc chamber constituents is desirable, typically to less than 20% of the total molar quantity of the halides present in the chamber constituents mix.

Lamps-91-00 and -91-01 are fabricated to otherwise be the same Lamp-81-03 except for increases in the amount of $CaI_2$ in the chamber constituents mix which for those lamps has been increased to 4.0 and 5.0 mg, respectively, as indicated in Table 3. Note that this increases the R9 index value, so as to have the first of these two lamps exhibit a R9 index value of +144, with the data indicating that the index saturation value is reached at about 5 mg of $CaI_2$. Comparing the data for Lamp-91-00 to that for Lamp-66-02 shows that the R9 index value of the first increased to +144 from the R9 index of +80 for the second. This result is an effect of the choice made in the amounts of NaI and LiI in the chamber constituents mix. In these particular lamps, NaI is reduced from 1.0 mg in the second lamp to 0.5 mg in the first lamp and a small amount of LiI is added to the chamber of the first lamp to recover the desired color temperature.

TABLE 4

| L A M P Nr | NaI [mg] | LiI [mg] | $CaI_2$ [mg] | $AlI_3$ [mg] | TlI [mg] | $DyI_3$ [mg] | LPW | CCT [K] | Duv | CRI | R9 |
|---|---|---|---|---|---|---|---|---|---|---|---|
| -86-00 | 0.59 | 0.1 | 3.0 | 0.25 | 0.4 | 0.06 | 80.9 | 3680 | −4.1 | 80 | +138.2 |
| -86-01 | 0.59 | 0.1 | 4.0 | 0.25 | 0.4 | 0.06 | 77.4 | 3432 | −10.1 | 82 | +135.3 |

Other metal halides may be added to the arc discharge chamber constituents for the purpose of increasing corresponding CCT values as shown in Table 4.

The lamps for which corresponding data is presented in Tables 1, 2, 3 and 4 all have therein a corresponding arc discharge chamber 20 of similar construction thus leading to all having a corresponding wall loading of 30 W/cm$^2$ or more. This data indicates that lamps containing $CaI_2$ in molar quantities between 55 and 75% of the total corresponding molar quantity of the halides present in the chamber leads to the overall emission by the lamp of white light with color values close to the blackbody characteristic.

Table 5 presents the data taken for lamps having a 3000 K CCT value obtained through including greater amounts of $CaI_2$ in the arc chamber constituents mix. All of these lamps have relatively very high amounts of $CaI_2$ included in the constituents mix of the corresponding discharge chambers in molar quantities all exceeding 78% of the total corresponding molar quantities of halides present in the chamber. Indeed, lamps have been found to provide good color performance for including $CaI_2$ in the mix anywhere in the range of 76 to 99% of the total molar quantities of halides present in chamber 20.

TABLE 5

| LAMP Nr | NaI [mg] | LiI [mg] | $CaI_2$ [mg] | $AlI_3$ [mg] | TlI [mg] | $DyI_3$ [mg] | LPW | CCT [K] | Duv | CRI | R9 |
|---|---|---|---|---|---|---|---|---|---|---|---|
| 011905-1 | 0.75 | 0.0 | 6.0 | 0.25 | 0.4 | 0.0 | 81.8 | 3048 | −10.0 | 81 | +118.5 |
| 011905-4 | 0.75 | 0.0 | 7.0 | 0.25 | 0.4 | 0.0 | 78.4 | 3176 | −12.2 | 77 | +142.7 |
| 011905-8 | 0.575 | 0.0 | 6.0 | 0.25 | 0.4 | 0.425 | 81.3 | 3438 | −15.1 | 84 | +130.8 |

Values of the molar ratio $CaI_2$/NaI have to be kept above 4 to thereby obtain high values for the red color rendering index R9 and to obtain desired CCT values. Any diminution in the value of this last ratio below 4 also diminishes the obtainable values of the index R9. In addition, the $CaI_2$/TlI molar ratio has to be kept above about 16 to avoid having Duv values become larger than are reasonably acceptable for the white hue of the lamp emissions while also maintaining the desired CCT and index R9 values for these emissions.

Table 7 presents data taken for lamps having a 3500K CCT value formed with arc discharge chambers 20 therein having amounts of $CaI_2$ equal to about 27% of the total molar quantities of halides present in the chamber, and which can range between 2% and 28% of the total molar quantities of halides present in the chamber. Lamp #198-01-01 was fabricated as a measurement reference lamp by excluding $CaI_2$ from its arc discharge chamber leading to the lamp having a R9 index value measured to be about −9.0. The presence of $CaI_2$ in the chambers of the remaining lamps in this table gave them increased index R9 values of as much as +18.5.

TABLE 7

| LAMP Nr | NaI [mg] | $CaI_2$ [mg] | TlI [mg] | $HoI_3$ [mg] | $TmI_3$ [mg] | $DyI_3$ [mg] | $CeI_3$ | LPW | CCT [K] | Duv | CRI | R9 |
|---|---|---|---|---|---|---|---|---|---|---|---|---|
| 198-01-01 | 0.64 | 0.00 | 0.43 | 0.48 | 0.48 | 0.48 | 0.00 | 79.6 | 3826 | +9.6 | 80 | −9.0 |
| 198-10-02 | 0.47 | 0.58 | 0.18 | 0.18 | 0.21 | 0.40 | 0.07 | 80.9 | 3421 | +5.3 | 86 | +18.5 |
| 198-11-05 | 0.68 | 0.83 | 0.25 | 0.26 | 0.30 | 0.58 | 0.10 | 81.9 | 3400 | +4.3 | 86 | +13.0 |
| 198-11-06 | 0.68 | 0.83 | 0.25 | 0.26 | 0.30 | 0.58 | 0.10 | 81.5 | 3616 | +5.1 | 84 | +3.9 |

Five lamps with a power rating of 150 watts containing $CaI_2$ among their arc discharge chamber constituents are represented in Table 6 along with Lamp A which again represents a typical commercially available 3000 K CCT value lamp with a red color rendering index R9 value of −18. All lamps in Table 6, except Lamp A, contain NaI and $CaI_2$ in a molar ratio $CaI_2$/NaI having values greater than 1.0. Tl salt was added to the chamber constituents so as to have the resulting ratio $CaI_2$/TlI be of values greater than 4.8 but less than 8.5. Such $CaI_2$/NaI and $CaI_2$/TlI molar ratios produce lamp emissions with white light such that Duv<5. The lamps according to this invention have superior red rendering index R9 values from 43 through 125 which are substantially greater than the reference Lamp A index R9 value of −18. As seen in Table 6, the amount of $CaI_2$ is in a molar quantity between 51 and 54% of the total molar quantity of halides present in the lamp arc discharge chambers.

The data in Table 7 allow inferring that the lamps of the present invention have good color performance for arc discharge chambers 20 therein containing $CaI_2$ in the mix anywhere in the range of 2 to 28% of the total molar quantities of halides present in the chamber.

Values of the molar ratio $CaI_2$/NaI have to be kept above 0.5 to thereby obtain high values for the red color rendering index R9 and to obtain desired CCT values for the amounts of $CaI_2$ present in the chamber constituents in the range of 2 to 28% as a fraction of the total molar quantity of halides therein. As values of the molar ratio $CaI_2$/NaI become less than 0.5, NaI tends to dominate and the CCT values decline while the index R9 values are also diminished. However, values of the molar ratio $CaI_2$/TlI also need to be greater than about 3 to achieve acceptable values of Duv (<about 10).

Other constituents in the arc discharge chamber mixes provided to further aid lamp performance must also be added

TABLE 6

| Lamp Nr | NAI [mg] | $CaI_2$ [mg] | TlI [mg] | $HoI_3$ [mg] | $TmI_3$ [mg] | $DyI_3$ [mg] | $AlI_3$ [mg] | LPW | CCT [K] | Duv | CRI | R9 |
|---|---|---|---|---|---|---|---|---|---|---|---|---|
| Lamp A | 3.77 | 0.00 | 0.39 | 0.33 | 0.33 | 0.38 | 0.00 | 86.0 | 2937 | −4.1 | 84 | −18.0 |
| 188-64-00 | 1.00 | 3.00 | 0.70 | 0.00 | 0.00 | 0.00 | 0.50 | 80.2 | 3074 | −1.5 | 82 | +125.0 |
| 188-64-01 | 1.00 | 3.00 | 0.70 | 0.00 | 0.00 | 0.00 | 0.25 | 94.8 | 2955 | +1.4 | 87 | +55.0 |
| 188-66-04 | 1.06 | 3.00 | 0.50 | 0.00 | 0.00 | 0.34 | 0.25 | 92.63 | 3052 | −0.5 | 87 | +70.0 |
| 188-69-00 | 1.00 | 3.00 | 0.70 | 0.00 | 0.00 | 0.00 | 0.25 | 97.7 | 2810 | +0.7 | 88 | +43.0 |
| 188-70-01 | 1.00 | 3.00 | 0.40 | 0.00 | 0.00 | 0.00 | 0.25 | 92.5 | 3136 | −0.4 | 83 | +61.0 |

to chambers 20 in only limited amounts. Although TlI is effective in increasing lamp efficacy, there is also a corresponding tendency to add a greenish hue to the lamp emissions forcing the Duv values to be larger, i.e. forcing the color values of the emitted light further from the blackbody characteristic, to thereby result in poorer quality white light. Thus, TlI is limited in the lamp arc discharge chambers to being less than about 18% of the total molar quantities of halides present in the chamber. Likewise, $DyI_3$ is limited for similar reasons to being less than about 20% of the total molar quantities of halides present in the chamber.

For simplicity of explanation, all descriptions of the metal halides utilized in the various lamps describe have been referred to as metal iodides but substituting metal bromides with the same metals for the described metal iodides yields similar results as indicated above.

Although the present invention has been described with reference to preferred embodiments, workers skilled in the art will recognize that changes may be made in form and detail without departing from the spirit and scope of the invention.

The invention claimed is:

1. An arc discharge metal halide lamp for use in selected lighting fixtures, said lamp comprising:

a discharge chamber having visible light permeable walls of a selected shape bounding a discharge region through which walls a pair of electrodes are supported in said discharge region spaced apart from one another; and ionizable materials provided in said discharge region of said discharge chamber comprising at least one member selected from a group consisting of halides of cerium, dysprosium, holmium, lithium, sodium, praseodymium, thallium and thulium, and further comprising a halide of calcium in a fraction between about seventy-six percent and ninety-nine percent of that weight total of all halides present in said discharge chamber and in a molar ratio greater than sixteen with respect any halide of thallium present in said discharge chamber.

2. An arc discharge metal halide lamp for use in selected lighting fixtures, said lamp comprising:

a discharge chamber having visible light permeable walls of a selected shape bounding a discharge region through which walls a pair of electrodes are supported in said discharge region spaced apart from one another; and ionizable materials provided in said discharge region of said discharge chamber comprising at least one member selected from a group consisting of halides of cerium, dysprosium, holmium, lithium, sodium, praseodymium, thallium and thulium with halides of thallium present in said discharge region of said discharge chamber in a fraction of less than eighteen percent of that weight total of all halides present in said discharge chamber, and further comprising a halide of calcium in a fraction between about fifty-five percent and seventy-five percent of that weight total of all halides present in said discharge chamber and in a molar ratio greater than six with respect any halide of thallium present in said discharge chamber such that visible light is emitted from said discharge chamber with a CCT value between 2700K and 3450K.

3. An arc discharge metal halide lamp for use in selected lighting fixtures, said lamp comprising:

a discharge chamber having visible light permeable walls of a selected shape bounding a discharge region through which walls a pair of electrodes are supported in said discharge region spaced apart from one another; and ionizable materials provided in said discharge region of said discharge chamber comprising a halide of aluminum and at least one member selected from a group consisting of halides of cerium, dysprosium, holmium, lithium, sodium, praseodymium, thallium and thulium, and further comprising a halide of calcium in a fraction between about seventy-six percent and ninety-nine percent of that weight total of all halides present in said discharge chamber and in a molar ratio greater than sixteen with respect any halide of thallium present in said discharge chamber.

4. An arc discharge metal halide lamp for use in selected lighting fixtures, said lamp comprising:

a discharge chamber having visible light permeable walls of a selected shape bounding a discharge region through which walls a pair of electrodes are supported in said discharge region spaced apart from one another; and ionizable materials provided in said discharge region of said discharge chamber comprising a halide of aluminum and at least one member selected from a group consisting of halides of cerium, dysprosium, holmium, lithium, sodium, praseodymium, thallium and thulium, and further comprising a halide of calcium in a fraction between about fifty-five percent and seventy-five percent of that weight total of all halides present in said discharge chamber and in a molar ratio greater than six with respect any halide of thallium present in said discharge chamber.

5. An arc discharge metal halide lamp for use in selected lighting fixtures, said lamp comprising:

a discharge chamber having visible light permeable walls of a selected shape bounding a discharge region through which walls a pair of electrodes are supported in said discharge region spaced apart from one another; and ionizable materials provided in said discharge region of said discharge chamber comprising a halide of aluminum and at least one member selected from a group consisting of halides of cerium, dysprosium, holmium, lithium, sodium, praseodymium, thallium and thulium, and further comprising a halide of calcium in a fraction between about two percent and twenty-eight percent of that weight total of all halides present in said discharge chamber and in a molar ratio greater than three with respect any halide of thallium present in said discharge chamber.

6. An arc discharge metal halide lamp for use in selected lighting fixtures, said lamp comprising:

a discharge chamber having visible light permeable walls of a selected shape bounding a discharge region through which walls a pair of electrodes are supported in said discharge region spaced apart from one another; and ionizable materials provided in said discharge region of said discharge chamber comprising at least one member selected from a group consisting of halides of cerium, dysprosium, holmium, lithium, sodium, praseodymium, thallium and thulium, and further comprising a halide of calcium in a fraction between about fifty-one percent and fifty-four percent of that weight total of all halides present in said discharge chamber and in a molar ratio greater than four and eight tenths with respect any halide of thallium present in said discharge chamber but less than eight and five tenths.

7. An arc discharge metal halide lamp for use in selected lighting fixtures, said lamp comprising:

a discharge chamber having visible light permeable walls of a selected shape bounding a discharge region through which walls a pair of electrodes are supported in said discharge region spaced apart from one another; and ionizable materials provided in said discharge region of said discharge chamber comprising a halide of aluminum and at least one member selected from a group consisting of halides of cerium, dysprosium, holmium, lithium, sodium, praseodymium, thallium and thulium, and further comprising a halide of calcium in a fraction between about fifty-one percent and fifty-four percent of that weight total of all halides present in said discharge chamber and in a molar ratio greater than four and eight tenths with respect any halide of thallium present in said discharge chamber but less than eight and five tenths.

* * * * *